US005139040A

United States Patent [19]

Kelly

[11] Patent Number: 5,139,040

[45] Date of Patent: Aug. 18, 1992

[54] COLLAPSIBLE LIGHTWEIGHT CRUTCH

[76] Inventor: James V. Kelly, 2617 Amarillo Blvd. E., Amarillo, Tex. 79107

[21] Appl. No.: 743,177

[22] Filed: Aug. 9, 1991

Related U.S. Application Data

[63] Continuation-in-part of Ser. No. 465,365, Jan. 16, 1990.

[51] Int. Cl.[5] ..... A61H 03/02

[52] U.S. Cl. ..... 135/69; 135/75; 403/108

[58] Field of Search ..... 135/68, 69, 72, 74, 135/75, 65, 909; 403/108, 328

[56] References Cited

U.S. PATENT DOCUMENTS

| | | | |
|---|---|---|---|
| 2,711,183 | 6/1955 | Lofstrand, Jr. | 135/69 |
| 2,741,255 | 4/1956 | Neptune | 135/72 |
| 2,817,348 | 12/1957 | Holliday, Jr. | 135/72 X |
| 3,768,495 | 10/1973 | Smith | 135/69 X |
| 3,947,140 | 3/1976 | Thomas | 135/69 X |
| 4,809,725 | 3/1989 | Champigny | 135/75 |
| 4,869,280 | 9/1989 | Ewing | 135/69 |

FOREIGN PATENT DOCUMENTS

| | | | |
|---|---|---|---|
| 658490 | 10/1951 | United Kingdom | 403/108 |

*Primary Examiner*—David A. Scherbel
*Assistant Examiner*—Lan Mai
*Attorney, Agent, or Firm*—Cornelius J. Husar

[57] ABSTRACT

The disclosure relates to a crutch which is readily disassembled into a plurality manageable components which can be conveniently tucked away when not in use. The components can be easily adjusted to accommodate persons of different heights. A significant safety feature of the disclosure is the fact that each of the two release subassemblies is provided with a release pin sleeve that ensures a quick and efficient release of the release pin and subsequent re-engagement without the release pin hanging-up and thereby preventing injury to the user. A first embodiment discloses the height adjusting support member receiving both the upper and lower support members therein, while the second embodiment discloses the height adjusting member receiving only the upper support member therein with the lower support member receiving the height adjusting member therein.

5 Claims, 1 Drawing Sheet

COLLAPSIBLE LIGHTWEIGHT CRUTCH

RELATED APPLICATION

This application is a continuation-in-part of applicant's co-pending application Ser. No. 07/465,365 filed Jan. 16, 1990.

FIELD OF THE INVENTION

This invention relates to crutches, and more particularly, to a collapsible crutch which can be disassembled into several pieces which can be placed in a compact relationship to each other for purposes of storage, transport or temporary non-use situations.

BACKGROUND OF THE INVENTION

Most crutches which have been heretofore provided have caused considerable difficulties in terms of compact storage of the crutches, and the ability to use the crutch without difficulty, followed by placement of the crutch in an unobtrusive, out-of-the-way position when it is not in use, and is to be laid down in a crowded situation where space is at a premium. Wooden, forearm and all metal types of crutches commonly seen are difficult to quickly release from the grasp of the user in the event of an emergency where the crutch will impede the ability of the user to protect himself in a fall, or control a fall to reduce the hazard thereof. The wooden, forarm and other types of metal crutches are of substantial length and cannot be disassembled into multiple convenient sized components when not in use. This causes a problem of storing the crutch, or of placing it in an out-of-the-way location where it does not interfere with the freedom of movement of the user or other persons in close proximity to the user.

Most conventional crutches also either do not provide for easy height adjustment to accommodate the crutch to users of different stature, or if such ability to reset the height of the crutch is present, the mechanism by which this is accomplished is less than optimum in that it requires considerable strength, or is so complicated that it is difficult to understand well enough to quickly, easily and unfailingly utilize the mechanism to adjust the height or disassembly of the crutch.

BRIEF DESCRIPTION OF THE INVENTION

The present invention provides an improved, lightweight, mechanically stong crutch which can be disassembled into several components, each of which is relatively small in its overall dimension, thereby facilitating the storage and carriage of the crutch in a small compact bag or carrying case anytime that the crutch is not in use.

The crutch of the invention further can be quickly assembled and its overall height or length changed to accommodate it to differently sized users.

Broadly described, the crutch of the present invention includes a plurality of telescopingly engage parts which are each provided with registering apertures which function, in conjunction with a release pin assembly, to allow the relative positions of the telescopingly engaged parts of the crutch to be change, thereby changing the overall length of the crutch as may be needed for different users.

The release pin subassembly can be easily used and requires only thumb pressure to actuate the mechanism and allow the height of the crutch to be adjusted as desired. On one of the telescopingly engaged parts of the crutch, a hand piece is secured and projects outwardly. The hand piece is arranged on the crutch so that it extends at an angle of from about 20 degrees to about forty degrees with respect to the plane of an underarm support assembly which is located at the top of the crutch. Because of this orientation of the handle, the crutch is more easily and safely used than crutches previously available.

An important object of the present invention is to povide a crutch of improved strength and enhanced safety in use which, because of the way the handle is constructed in relation to the underarm support assembly, permits the crutch to be quickly released, if this is desirable, at a time when the user of the crutch may be falling.

Another object of the invention is to provide a crutch which is compact in its configuration so as to offer less chance of injury to a person, or interference with others, from the user of the crutch walking in public places where space is limited, and the crutch movements must be carefully controlled.

Another object of the invention is to provide a crutch which has a handle (which is gripped by the user) free at the end so that it can be immediately released, and which projects generally forwardly from the forward side of the crutch so that better security and balance is provided for the initial use of the crutch by a beginner first learning its use. The location of the handle toward the forward side of the crutch also gives better balance, and reduces the risk of falling.

Another object of the invention is to provide a crutch that includes a pair of release pin sleeves which greatly enhances the safety aspect of the release pins.

another object of the invention is to provide a crutch wherein the release pin sleeves ensure the re-engagement of the release pins after assembly, disassembly or length adjustment.

A further advantage of the crutch of the invention is that the crutch can be easily and quickly adjusted over a wide range so as to accommodate persons of different heights.

Another object is to provide a collapsible, easily transportable and multi-part crutch which, because of the way it is made, can be quickly assembled to a preselected height, and can then be repeatedly reassembled to that same height without need for time consuming re-adjustment during each use.

A further object of the invention is to provide a crutch which can be disassembled into several parts and stored in a compact space so that it is not inconvenient, nor does it cause a problem of obstruction when used in public places, such as at sporting events and the like.

Additional objects and advantages of the invention will become apparent as the following detailed description of the invention is read in conjunction with the accompanying drawings which illustrate two preferred embodiments of the invention.

GENERAL DESCRIPTION OF THE DRAWINGS

DETAILED DESCRIPTION OF A PREFERRED EMBODIMENT OF THE INVENTION

Figure 1:
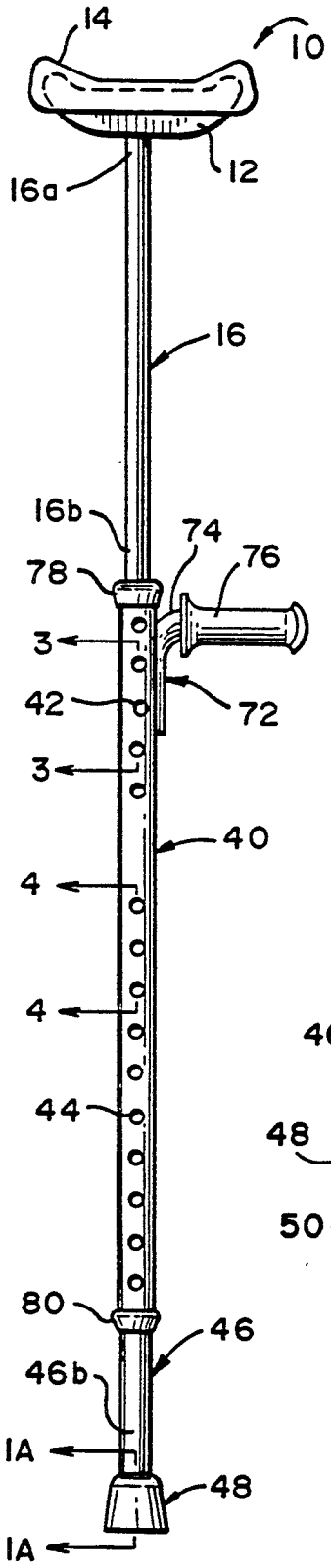
FIG. 1 is a side elevation view of the crutch of the invention.

Referring to FIG. 1 of the drawings, an underarm support subassembly 10 is located at the top of the crutch. The support subassembly includes a fiberglass, plastic or other suitable pad 12, which is dimensioned to fit the arm pit of the user of the crutch, and a pad cover 14, made of soft rubber or other soft material, which fits snugly over the pad 12.

The underarm support subassembly 10 is secured to the upper end of an elongated tubular upper support member 16. The tubular upper support member 16 is preferably an aluminum tube which has an outside diameter of about seven-eighths inch. The tubular upper support member 16 has an upper end 16*a* and a lower end 16*b* having a radial opening 18 formed therethrough. Pressed into the lower end of the member 16, and frictionally retained therein or other suitable securing means, is an upper release pin assembly 19. The upper release pin assembly 19 includes an upper release pin sleeve 20 (see FIG. 3). The release pin sleeve 20 has a radial opening 21 formed therethrough at a location in alignment with the opening 18. A release pin spring 22 of generally U-shaped configuration is pressed into the upper release pin sleeve 20 in the manner illustrated in FIG. 3. The release pin spring 22 has a reverse bent end 24 thereon which extends substantially normal to the side wall of the release pin sleeve 20.

Figure 3:
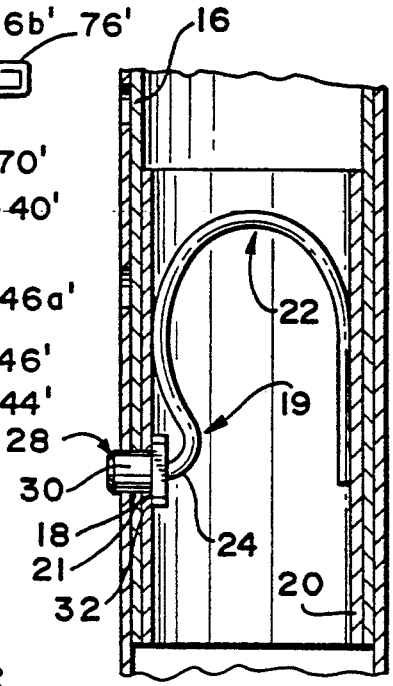
FIG. 3 is a sectional view taken along line 3—3 of FIG. 1.

A release pin 28 is secured to the reverse bent end 24 of the release pin spring 22. The release pin 28 includes a rounded or beveled head 30 and a limit flange 32. As shown in FIG. 3, the rounded head 30 of the release pin 28 is dimensioned to project through the aligned opening 18 and 21 in the upper release pin sleeve 20 and the tubular upper support member 16, respectively. The head 30 is also of a size such that it will also project through, and interlock with, a selected registering aperture in the upper end portion of an elongated cylindrical height adjustment tube 40, as hereinafter described.

A significant safety feature of this unique arrangement utilizing a release pin sleeve 20 in conjunction with release pin 28 is the fact that once release pin 28 has been depressed to permit adjustment, release pin 28 has a second wall thickness surrounding itself, i.e. the wall of opening 18 in release sleeve 20 and thus when pin 28 is released to re-enter an aperture in height adjustment tube 40 it will unfailingly do so rather than "hang-up" as frequently happens when pin 28 is temporarily retracted into a single thickness of material as would be the case without my release pin sleeve 20.

It can readily be seen that a person relying on the proper extension of release pin 28 into a apertue in adjustment tube 40 and then placing his full body weight onto a crutch thinking that it would be properly supported could seriously injure himself when the crutch collapses due to improper re-engagement of release pin 28 in an aperture of height adjustment tube 40.

It is to be noted that lower release pin subassembly 56 includes a lower release pin sleeve 58 which functions in the same manner as set forth above relative to upper release pin sleeve 20.

The height adjustment tube 40 is an elongated cylindrical member which has a plurality of aligned apertures formed from each of its ends for a distance along the length of the tube. These apertures include a group of upper apertures 42 and a group of lower apertures 44. These apertures 42 and 44 are identical to each other. The height adjustment tube 40 is diametrically dimensioned to permit it to telescope over the lower end portion of the tubular upper support member 16. When the height adjustment tube 40 is fitted over the lower end of the tubular upper support member 16, a selected one of the upper apertures 42 in the height adjustment tube can be brought into registry or alignment with the openings 18 and 21 formed in the tubular upper support member 16 and in the release pin sleeve 20, respectively. In this way, the length of the crutch can be adjusted through the use of the upper release pin 28 and a similar functioning lower release pin, hereinafter described. Thus, when the upper release pin 28 is pushed inwardly by the use of the thumb so that it is retracted inwardly of the inner wall of the height adjustment tube 40, such height adjustment tube can be slid in a telescoping motion relative to the tubular upper support member 16 to bring a selected different one of the apertures 42 into alignment with the openings 18 and 21, and thus permit the release pin to be reset, and the overall length of the tubular elements 40 and 16 to be selectively adjusted.

Figure 1A:
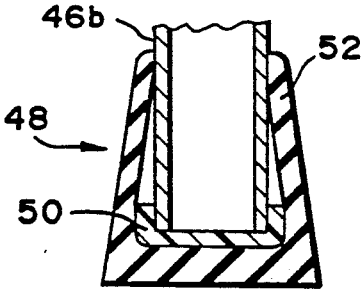
FIG. 1A is a sectional view taken alone line 1A—1A of FIG. 1.

The height adjustment tube 40 is also diametrically dimensioned to telescopingly engage the upper end portion of a tubular lower support member 46 as shown in FIG. 1. The tubular lower support member 46 is an elongated cylindrical member which has an upper end portion 46*a* and a lower end portion 46*b*. The lower end portion 46*b* of the tubular lower support member 46 is secured to a crutch tip subassembly 48. The crutch tip subassembly 48 includes a rubber tip protective cap 50 to prevent lower end portion 46*b* from cutting crutch tip cap 52. The manner in which these are assembled is best illustrated in FIG. 1A of the drawings.

Figure 4:
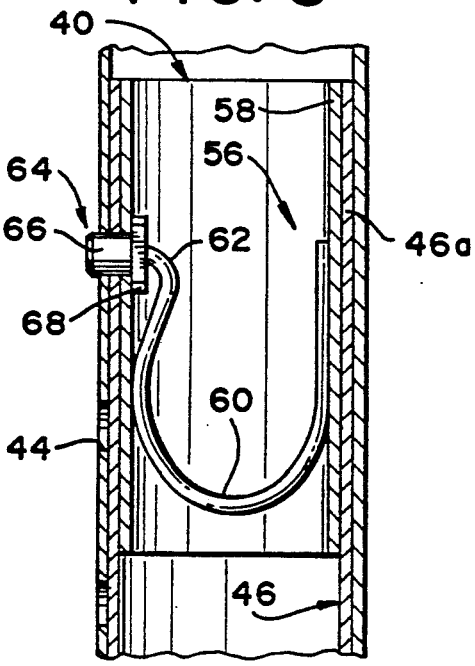
FIG. 4 is a sectional view taken along line 4—4 of FIG. 1.

The upper end portion of the tubular lower support member 46 receives a lower release pin subassembly, designated generally by reference 56. The lower release pin subassembly 56 includes a lower release pin sleeve 58. The lower release pin sleeve 58 is dimensioned to permit it to be forced into the upper end portion of the tubular lower support member 46. Once it is pressed into the position illustrated in FIG. 4, it will remain in this position by reason of the tight fit. The lower release pin subassembly 56 includes, in addition to the lower release pin sleeve 58, a lower release pin spring 60 which is substantially identical in its U-shaped configuration and construction to the upper release pin spring 22 previously described. Thus, at one of its ends, the release pin spring 60 carries a reverse bent end portion 62 which is joined to a release pin which has a head 66 and a limit flange 68.

The manner in which the height adjustment tube 40 is used in cooperation with the tubular lower support member 46 for the purpose of adjusting the overall length of the crutch corresponds substantially identically to the method of cooperation between the height adjustment tube and the tubular upper support member 16 as hereinbefore described. Thus, both the lower release pin subassembly 56 and the upper release pin subassembly 19 are employed for this purpose, and allow this overall length adjustment to be accomplished by the depression of the release pins in each of the subassemblies to enable the height adjustment tube to be telescoped relative to either one, or both, of the tubular support members 16 and 46 and also to provide easy assembly and disassembly.

At a location near its upper end, the height adjustment tube 40 carries an L-shaped hand support subassembly 70. The hand support subassembly 70 includes an L-shaped rigid metallic tubular element 72. The tubular element 72 is secured to the upper end portion of the elongated height adjustment tube 40 by brazing one of the legs of the tubular element to the outer surface of the upper end portion of the height adjustment tube. When the leg of the tubular element 72 is so joined to the height adjustment tube 40, a tubular part 74 interconnects the hand support subassembly 76 with the other leg 72 of the L-shaped element. A cylindrical hand grip sleeve 76' is carried by hand support 76. The sleeve 76' constricts tightly about the tubular part 76 so as to provide a hand grip which will not slip.

Figure 2:
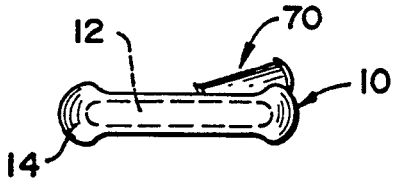
FIG. 2 is a plan view of the crutch of the invention.

One aspect of importance in the present invention is the way the hand support subassembly 70 is oriented in relation to the underarm support subassembly 10. Reference to FIG. 2 will show that when the underarm support subassembly 10 is oriented in the position shown, the hand support subassembly is offset from the major plane of the underarm support subassembly by an angle of from about 20 degrees to about 40 degrees. Moreover, it extends generally forwardly rather than rearwardly when the crutch is in use. This greatly facilitates the use of the crutch.

In order to permit semi-permanent retention of a given crutch height adjustment, effected by the use of the height adjustment tube 40 through the adjustment of its linear relationship to the tubular upper support member 16 and the tubular lower support means 46, a pair of height adjustment retention rings 78 and 80 are provided. These rings are preferably constructed of an elastomeric material which will enable them to constrict tightly around the respective tubular upper support member 16 and the tubular lower support member 46. Once these retention rings 78 and 80 have been set at given locations along these tubular support members, they will remain at those locations and serve as indexing elements or stops which will always line up the appropriate apertures 42 and 48 in the height adjustment tube 40 with the aligned openings formed through the release pin sleeves 20 and 58, and through the respective tubular upper support member 16 and tubular lower support member 46.

In the use of the crutch, it is first removed from a suitable carrying case or bag in which it can be compactly stored and carried. Storage is effected by disassembling the several parts of the crutch to allow it to be placed in a compact form in which the three tubular interfitting and telescoping major sections of the crutch are broken down and placed in side-by-side contacting relationship. After removal from the carrying bag, the crutch is assembled by inserting the lower end portion of the tubular upper support member 16 into the upper end of the height adjustment/tube 40. Similarly, the upper end portion of the lower tubular support member 46 is inserted into the lower end portion of the height adjustment tube 40. If it be assumed that the crutch is being used for the first time by a user who needs to set the overall height of the crutch to fit his personal stature, he will do this by making adjustments in the relative positions of the three telescoping tubular elements. Selected ones of the apertures 42 and 44 in the height adjustment tube are engaged by the release pins in the upper and lower release pin subassemblies so that the pins snap into the appropriate selected apertures in the height adjustment tube to assure that the overall height of the crutch is exactly right for the individual who is going to use it.

At this time, and after the height adjustment has been made in the manner described, the height adjustment retention rings 78 and 80 are manually forced along the respective upper support member 16 and lower support member 46 until these retention rings abut the ends of the height adjustment tube 40. Once this relationship has been achieved at the time of the initial adjustment of the overall height of the crutch, no difficulty will thereafter be experienced in assembling the crutch into the correct position, since the height retention rings 78 and 80 will remain in this position until they are intentionally shifted from this position by the user of the crutch. Such a re-adjustment in the overall height of the crutch might be desirable, for example, if the crutch is to be utilized by a different person.

Figure 5:
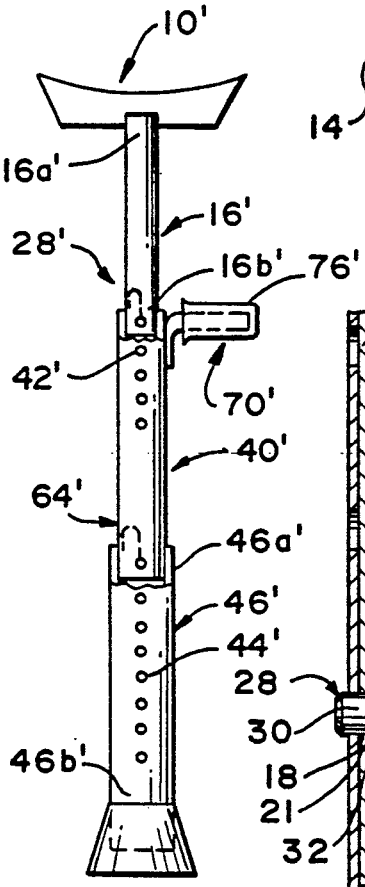
FIG. 5 is an elevational view of a modification of the invention.

Referring now to FIG. 5, there is shown a modification of the crutch described in FIGS. 1–4. FIG. 5 is an illustration in reduced scale wherein lower extension member 46' is of larger diameter than height adjustment tube 40' which is received therein. Lower release pin assembly 64' is positioned within the lower end of height adjustment tube 40' and is provided with a lower release pin sleeve 58' which serves the same purpose as described relative to the first embodiment.

With respect to upper release pin assembly 28', tubular upper support member 16' receives upper release pin sleeve 20' and also serves the same purpose as described relative to the embodiment of FIGS. 1–4. It is to be noted that the embodiment of FIG. 5 contains the same components as the first embodiment, for ease of understanding the same reference numerals designate like parts however, in the FIG. 5 embodiment, each reference numeral includes the prime mark (').  Although the same components are used in FIG. 5, the basic difference is the fact that lower support member 46' is of larger diameter and receives height adjustment tube 40' therein. It can readily be seen that the diameters of upper support member 16', height adjustment tube 40' and lower support member 46' progressively get larger with lower support member 46' having the largest diameter which helps provide greater stability to the user. Further, although release pin sleeves 20' and 58' are shown only in dashed lines in FIG. 5, it is to be understood that release pin sleeves 20' and 58' are, in fact, used in this embodiment in the same manner as set forth with respect to FIGS. 3 and 4.

Additionally, it is to be noted that height adjustment tube 40' is provided with an upper set of adjustment apertures 42' which are engaged by upper release pin assembly 28'. Lower support member 46' is of larger diameter than height adjustment tube 40' and is provided with a plurality of adjustment apertures 44'. Selective use of these apertures 42' and 44' provide the desired crutch length for a particular user.

Applicant, in addition to being the inventor of this novel crutch, is also a user of the crutch. It is through his personal first-hand experiences that he became aware of the many problems encountered in using currently available crutches. The concept of making a crutch of a plurality of readily manageable components, each of which is approximately the same overall length, allows the crutch to be quickly and efficiently disassembled and stored in a convenient handbag or carrying case when not in use and thus avoid the usual hassel and problems associated with a conventional non-collapsible full size crutch or other release pin type crutches.

Although preferred embodiments of the invention have been herein described in order to enable those skilled in the art to understand and practice the invention, various changes and innovations can be made in the illustrated and described structure without departure from the basic principles which underlie the invention. Changes and innovations of that type are therefore deemed to be circumscribed by the spirit and scope of the invention, except as the same may be necesarily limited by the appended claims when such claims are given a reasonable expansive interpretation.

What is claimed:

1. A readily collapsible and disassembleable crutch comprising:

an underarm support assembly;

an elongated tubular upper support member having a lower end portion defining a radial opening therethrough and a lower terminal end;

an upper release pin sleeve mounted at the lower terminal end of said elongated tubular upper support member;

said upper release pin sleeve having an axial length greater than its diameter and a radial opening in alignment with said opening in said elongated tubular upper support member;

a centrally located height adjustment tube diametrically dimensioned to telescopingly slide over the outer surface of said lower portion of said elongated upper tubular support member;

said height adjustment tube having a first plurality of spaced apertures adjacent its upper end and a second plurality of spaced apertures in the lower portion thereof;

an upper release pin subassembly secured witin said upper release point sleeve; said upper release pin subassembly comprising:

an upper release pin having an elongated body portion with a tapered forward end and a limit flange attached to the opposite end thereof;

an upper release pin spring having one end resiliently biased toward and engaging the inner surface of said upper release pin sleeve and having a second end secured to said limit flange of said upper release pin, said upper release pin spring resiliently biasing said upper release pin into, and radially outwardly through aligned openings in each of said release pin sleeve, said upper support member, and one of said plurality of openings adjacent said upper end of said centrally located height adjustment tube;

an elongated tubular lower support member having a lower end and an upper end; said lower end receiving a crutch tip assembly thereon;

said upper end of said elongated tubular lower support member having an opening extending radially therethrough and defining an upper terminal end;

a lower release pin sleeve mounted in the upper terminal end of said elongated tubular lower support member and having a radial opening in alignment with said radially extending opening in said upper end of said elongated tubular lower support member;

said lower release pin sleeve having an axial length greater than its diameter;

a lower release pin subassembly secured within said lower release pin sleeve, said lower release pin subassembly comprising:

a lower release pin identical to said upper release pin;

a lower release pin spring having one end resiliently biased toward and engaging the inner surface of said lower release pin sleeve and having a second end secured to the limit flange of said lower release pin;

said lower release spring resiliently biasing said lower release pin into and radially outwardly through said opening in each of said lower release pin sleeve, said upper end portion of said elongated tubular lower support member and one of said plurality of openings adjacent the lower portion of said centrally located height adjustment tube; whereby depressing of either said upper or lower release pin forces said selected release pin into its respective release pin sleeve opening and release of said selected release pin immediately allows said pin to move outwardly through the desired openings without said release pin handing-up, thus ensuring proper engagement of said release pin with the desired adjustment openings and preventing injury to the user due to improper pin engagement.

2. A collapsible crutch of the character defined in claim 1 wherein said height adjustment tube means includes a plurality of vertically aligned spaced apertures extending through the wall thereof; said apertures selectively cooperating with said upper release pin means to provide height adjustment of said underarm support subassembly.

3. A collapsible crutch of the character defined in claim 1 wherein said elongated tubular lower support means includes a plurality of vertically aligned spaced apertures extending through the wall thereof; said apertures selectively cooperating with said lower release pin means to provide height adjustment of said elongated tubular lower support member.

4. A collapsible crutch of the character defined in claim 1 wherein said centrally located height adjustment tube means includes a handgrip which is attached to the outer wall thereof; said handgrip disposed in a horizontal orientation at an angle of twenty to forty degrees outward of vertical plane passing through said underarm support assembly.

5. A readily collapsible and disassembled crutch of the character defined in claim 1 wherein each of said tubular support members is of approximately the same overall length to permit compact storage upon disassembly.

* * * * *